US011796141B2

(12) United States Patent
Van Bommel et al.

(10) Patent No.: US 11,796,141 B2
(45) Date of Patent: Oct. 24, 2023

(54) LIGHTING DEVICE COMPRISING AN LED STRIP

(71) Applicant: SIGNIFY HOLDING B.V., Eindhoven (NL)

(72) Inventors: Ties Van Bommel, Horst (NL); Rifat Ata Mustafa Hikmet, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/642,262

(22) PCT Filed: Sep. 11, 2020

(86) PCT No.: PCT/EP2020/075516
§ 371 (c)(1),
(2) Date: Mar. 11, 2022

(87) PCT Pub. No.: WO2021/052886
PCT Pub. Date: Mar. 25, 2021

(65) Prior Publication Data

US 2022/0316666 A1 Oct. 6, 2022

(30) Foreign Application Priority Data

Sep. 17, 2019 (EP) ..... 19197798

(51) Int. Cl.
*F21S 4/28* (2016.01)
*F21K 9/275* (2016.01)
(Continued)

(52) U.S. Cl.
CPC ..... *F21S 4/28* (2016.01); *F21K 9/275* (2016.08); *F21V 23/009* (2013.01); *F21Y 2115/10* (2016.08)

(58) Field of Classification Search
CPC ..... F21V 23/009; F21K 9/275; F21S 4/28
See application file for complete search history.

(56) References Cited

U.S. PATENT DOCUMENTS 5,559,681 A 9/1996 Duarte
7,284,882 B2 10/2007 Burkholder
(Continued)

FOREIGN PATENT DOCUMENTS

DE 202015005908 U1 9/2015

OTHER PUBLICATIONS

Installing LED Flex Strips: Mounting Techniques; https:\\www.ledsupply.com.

*Primary Examiner* — Christopher E Dunay

(57) ABSTRACT

The invention relates to a lighting device (1) comprising an LED strip (100) with an elongated carrier (110) having a first carrier surface (111) and an opposite second carrier surface (112), a plurality of light-emitting diodes (120) arranged on the second carrier surface (112), and a light-transmissive encapsulant (130) encapsulating the plurality of light-emitting diodes (120). The lighting device (1) is arranged to be mounted to a mounting surface (210) of an object (200). For this purpose, it comprises a first attachment component (150) arranged on a first outer surface (141) of the LED strip (100) and a second attachment component (160) arranged on a second outer surface (142) of the LED strip (100). The first and second attachment components (150; 160) are for attaching the lighting device (1) in first and second mounting orientations, respectively. Each light-emitting diode (120) is arranged to provide a light beam (121) with a light output axis (122) that intersects at least one of the first and second outer surfaces (141; 142). This results in a relatively large difference between the light outputs in the first and second mounting orientations, thereby potentially extending the range of different applications wherein the lighting device can be used.

14 Claims, 9 Drawing Sheets

(51) Int. Cl.
*F21V 23/00* (2015.01)
*F21Y 115/10* (2016.01)

(56) References Cited

U.S. PATENT DOCUMENTS

| | | | | |
|---|---|---|---|---|
| 9,379,289 | B1 | 6/2016 | Lindblad et al. | |
| 10,801,716 | B1 * | 10/2020 | Lopez-Martinez | F21V 15/01 |
| 11,266,014 | B2 * | 3/2022 | Holec | H01R 13/717 |
| 11,592,171 | B1 * | 2/2023 | McKay | F21S 4/28 |
| 2008/0225523 | A1 | 9/2008 | De Samber et al. | |
| 2009/0173958 | A1 * | 7/2009 | Chakraborty | H01L 33/501 257/E33.001 |
| 2014/0218909 | A1 * | 8/2014 | Tetsuo | F21V 5/043 362/244 |
| 2015/0069442 | A1 | 3/2015 | Liu et al. | |
| 2019/0074417 | A1 * | 3/2019 | Andrews | H01L 33/60 |
| 2019/0191543 | A1 | 6/2019 | Han | |
| 2021/0301989 | A1 * | 9/2021 | Deurenberg | F21V 23/06 |
| 2021/0372597 | A1 * | 12/2021 | Windisch | H01L 25/0753 |
| 2022/0003366 | A1 * | 1/2022 | Lee | F21S 4/28 |
| 2022/0010955 | A1 * | 1/2022 | Katou | F21V 9/30 |
| 2022/0102597 | A1 * | 3/2022 | Low | H01L 33/60 |
| 2023/0089209 | A1 * | 3/2023 | Van Eeuwijk | F21V 33/0012 |

* cited by examiner

LIGHTING DEVICE COMPRISING AN LED STRIP

CROSS-REFERENCE TO PRIOR APPLICATIONS

This application is the U.S. National Phase application under 35 U.S.C. § 371 of International Application No. PCT/EP2020/075516, filed on Sep. 11, 2020, which claims the benefit of European Patent Application No. 19197798.2, filed on Sep. 17, 2019. These applications are hereby incorporated by reference herein.

FIELD OF THE INVENTION

The invention relates to a lighting device arranged to be attached to a mounting surface of an object, wherein the lighting device comprises an LED strip. The invention further relates to a luminaire comprising the aforementioned lighting device.

BACKGROUND OF THE INVENTION

An LED strip is a component with a plurality of light-emitting diodes arranged on a surface of an elongated carrier. The elongated carrier is typically a printed circuit board, which may be flexible, and the plurality of light-emitting diodes is typically arranged in the form of a linear array. The plurality of light-emitting diodes, and optionally also the carrier, may be encapsulated with a light-transmissive encapsulant.

Lighting devices comprising LED strips are widely available and commonly used for consumer as well as professional applications in indoor and outdoor lighting.

Depending on the application, the lighting device should have a desired light distribution or light output, which is usually different from one application to the other. A lighting device comprising a LED strip is typically arranged to provide a light distribution or light output that is designed to suit a specific application.

SUMMARY OF THE INVENTION

There is a need to have a lighting device according to the opening paragraph that can be used in a larger variety of different applications, and it is an object of the invention to provide such an improved lighting device.

According to a first aspect of the invention, the lighting device comprises an LED strip, and the LED strip comprises (i) an elongated carrier having a first carrier surface and an opposite second carrier surface, (ii) a plurality of light-emitting diodes arranged on the second carrier surface, and (iii) a light-transmissive encapsulant encapsulating the plurality of light-emitting diodes.

The lighting device further comprises (i) a first attachment component arranged on a first outer surface of the LED strip for attaching the lighting device to the mounting surface in a first mounting orientation, the first attachment component (140) comprising a first adhesive portion (141) covered by a first release liner (142), and (ii) a second attachment component arranged on a second outer surface of the LED strip for attaching the lighting device to the mounting surface in a second mounting orientation, the second attachment component comprising a second adhesive portion covered by a second release liner.

Each light-emitting diode is arranged to provide a light output distributed around a light output axis, and the light output axis intersects at least one of the first and second outer surfaces.

The LED strip of the lighting device has a plurality of light-emitting diodes. Each light-emitting diode is arranged to emit light rays that together constitute a light beam. The light beam has a certain beam spread, which can be expressed as an angular range. The limits of the angular range refer to the edges of the light beam where the light intensity has decreased to a fraction of the beam's maximum intensity, such as 10%. The light rays are distributed around a light output axis. The light output axis is a parameter of the light beam and it typically coincides with the center of the light beam.

The encapsulant of the LED strip encapsulates at least the plurality of light-emitting diodes, but it may additionally also encapsulate the carrier. The encapsulant is light-transmissive. This means that light that is emitted by the plurality of light-emitting diodes is capable of passing through the encapsulant and of escaping from the encapsulant through one of its outer surfaces.

The lighting device has two attachment components. Each attachment component is for attaching the lighting device to a mounting surface of an object. For this purpose, each attachment component has an adhesive portion that is covered by a release liner. When one attachment component is used, the lighting device is mounted in a certain orientation, and when the other attachment component is used, it is mounted in a different orientation. In other words, the lighting device of the invention can be attached to a mounting surface of an object in at least two different orientations.

Each attachment component is provided on an outer surface of the LED strip. The outer surface may be a surface of the encapsulant, or a surface of the carrier. The outer surface may be a flat surface or a curved surface. At least one of the outer surfaces on which an attachment component is provided has a surface normal that is coincident with a light output axis of the plurality of light-emitting diodes. In other words, at least one light-emitting diode of the LED strip is arranged to emit a light beam in a direction away from or towards an outer surface of the LED strip on which an attachment component is provided.

The above structural features of the lighting device according to the invention ensure that a certain light distribution or light output can be obtained when the lighting device is attached in one orientation while another light distribution or light output can be obtained when it is attached in the other orientation. A single lighting device can now be used in combination with a single object to which it can be attached to provide at least two different light distributions or light outputs. Hereinafter, the terms light distribution and light output will be used interchangeably.

In the lighting device according to the invention, the first outer surface may coincide with the first carrier surface. In this case, at least part of the first carrier surface is not encapsulated by the encapsulant, and this part is then provided with the first attachment portion. The first outer surface and the first carrier surface may fully coincide such that they essentially constitute the same surface. A coincidence of the first outer surface and the first carrier surface has the advantage that thermal energy may be more easily dissipated from the lighting device when it is mounted in the first mounting orientation, particularly when the carrier of the LED strip and the object on which the lighting device is mounted are thermally conductive.

In the lighting device according to the invention, the first and second outer surfaces may be parallel planar surfaces. Alternatively, they may also be non-parallel planar surfaces, such as perpendicular planar surfaces. Non-parallel planar first and second outer surfaces has the advantage that a relatively large difference between the light outputs in the first and second mounting orientation may be achieved, thereby potentially extending the range of different applications wherein the lighting device can be used.

In the lighting device according to the invention, the elongated carrier may be light-reflective. For example, the surface of the carrier on which the light-emitting diodes are arranged may be light-reflective. The elongated carrier may have a reflectivity of at least 85%, such as more than 88% or even more than 90%. This has the advantage that the efficiency of the lighting device may be improved.

In the lighting device according to the invention, the elongated carrier may be light-transmissive. This means that a light ray that is incident on the carrier can subsequently pass through it. Examples of a light-transmissive carrier are a translucent carrier, a transparent carrier and a carrier that is arranged to redirect light. Translucency refers to the phenomenon that allows a light ray to pass through a medium, while it may be scattered at an interface, or internally, where there is a change in index of refraction. A special type of translucency is referred to as transparency, which refers to the phenomenon that allows a light ray to pass through a medium without being scattered.

In the lighting device according to the invention, the first attachment component may be arranged to provide a first optical effect and the second attachment component may be arranged to provide a second optical effect different from the first optical effect, wherein each of the first and second optical effects is an effect chosen from the group consisting of refraction, diffraction, reflection, diffusion and conversion. This has the advantage that a relatively large difference between the light outputs in the first and second mounting orientation may be achieved, thereby potentially extending the range of different applications wherein the lighting device can be used.

Refraction of light refers to the change in direction of a light ray passing from one medium to another or from a gradual change in the medium. Prisms and lenses may be used to redirect light by means of refraction.

Diffraction of light refers to various phenomena that occur when a light ray encounters an obstacle or a slit. It may be defined as the bending of light rays around the corners of an obstacle or through an aperture into the region of geometrical shadow of the obstacle or aperture, wherein the diffracting object or aperture effectively becomes a secondary source of the propagating light ray.

Reflection of lights refers to the change in direction of a light ray at an interface between two different media so that the light ray returns into the medium from which it originated. For specular reflection, the angle at which the light ray is incident on the surface equals the angle at which it is reflected. Specular reflection may be achieved by means of a mirror. For diffuse reflection, a light ray that is incident on a surface is scattered at many angles rather than at just one angle as in the case of specular reflection.

Diffusion of light refers to a situation wherein a light ray travels through a material without being absorbed, but rather undergoes repeated scattering events which change the direction of its path.

Conversion of light refers to a change in wavelength of a light ray, such as by means of photoluminescence, wherein light is emitted from any form of matter after absorption of electromagnetic radiation. Conversion of light by means of photoluminescence may be achieved by using a phosphor.

In the lighting device according to the invention, the first outer surface of the LED strip may face the first carrier surface of the elongated carrier, while the second attachment component is translucent. The first outer surface is the surface on which the first attachment component is provided. The first carrier surface is the surface of the carrier that is located opposite from the second carrier surface on which the light-emitting diodes are provided. When the first outer surface faces the first carrier surface, the two surfaces may be separate surfaces, they may coincide, or they may even be the same surface. In each case, the two surfaces should be considered to face each other. When the first outer surface faces the first carrier surface, the first attachment component will be provided at a location opposite from the second carrier surface on which the light-emitting diodes are provided, for example directly on the first carrier surface. The second attachment component may then be translucent, such as transparent.

In the lighting device according to the invention, the encapsulant may comprise a first encapsulant region and a second encapsulant region different from the first encapsulant region, wherein the first encapsulant region is adjacent to the carrier and the second encapsulant region is adjacent to the second attachment component, and wherein the second encapsulant region comprises one or more light-redirecting structures, such as prisms or lenses, for shaping the light beams emitted by the light-emitting diodes. This has the advantage that a relatively large difference between the light outputs in the first and second mounting orientation may be achieved, thereby potentially extending the range of different applications wherein the lighting device can be used.

In the lighting device according to the invention, the LED strip may have a third outer surface and the lighting device may have a third attachment component arranged on the third outer surface for attaching the lighting device to the mounting surface in a third mounting orientation, the third attachment component comprising a third adhesive portion covered by a third release liner. This has the advantage that the range of different applications wherein the lighting device can be used is extended.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily to scale.

DETAILED DESCRIPTION OF THE EMBODIMENTS

Figure 1:
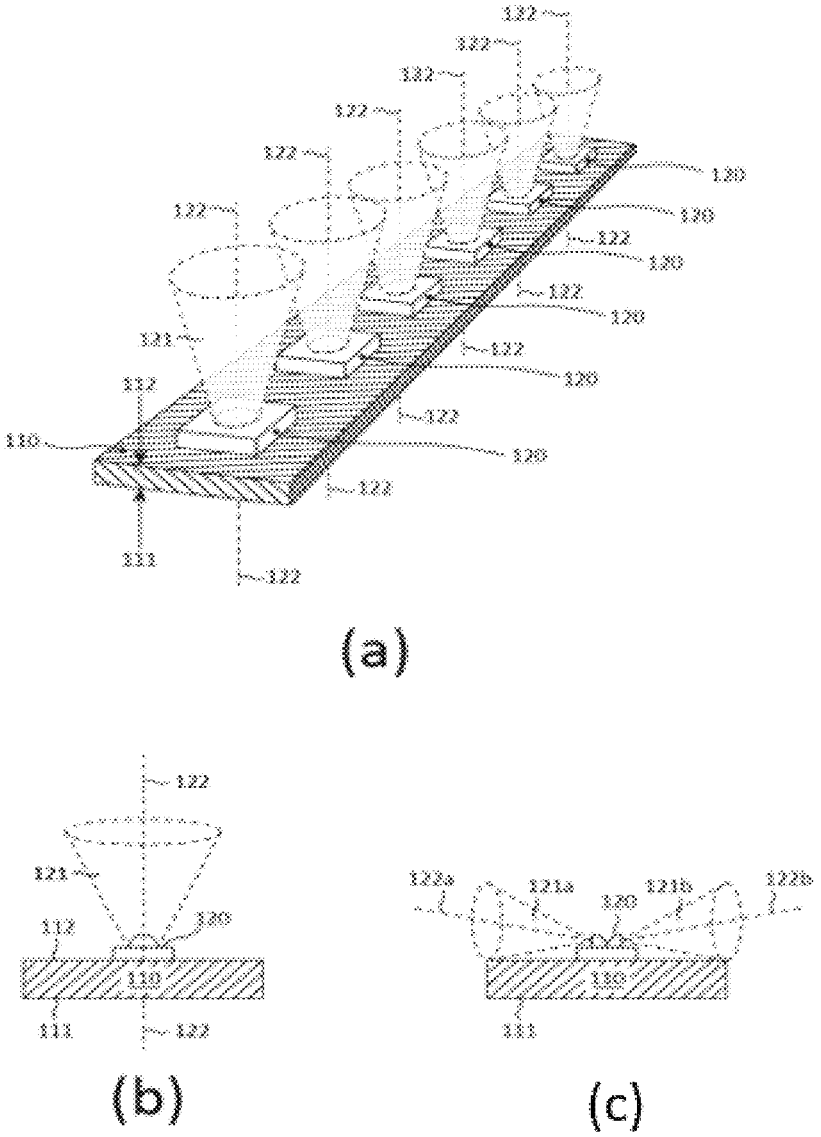
FIGS. 1(*a*) to 1(*c*) show examples of a carrier with a plurality of light-emitting diodes mounted on a surface thereof.

FIG. 1(*a*) shows a perspective view of a carrier 110 having a first carrier surface 111 and a second carrier surface 112 opposite the first carrier surface 111. The carrier 110 is elongated and a plurality of light-emitting diodes 120 is arranged on the second carrier surface 112.

The plurality of light-emitting diodes 120 is arranged in a linear array but may alternatively have any other arrangement. The plurality of light-emitting diodes 120 may comprise at least 20 light-emitting diodes, or at least 30 light-emitting diodes, or at least 40 light-emitting diodes or at least 50 light-emitting diodes.

The carrier 110 may be rigid or flexible. The carrier 110 may be a printed circuit board, or any other carrier suitable for mechanically supporting a plurality of light-emitting diodes. The carrier 100 may comprise multiple layers, including for example one or more thermally conducting layers, one or more thermally insulating layers, one or more electrically conducting layers and one or more electrically insulating layer.

Each of the light-emitting diodes 120 is arranged to emit a light beam 121 with a light output axis 122. The light beam 121 may be a white light beam, which may have a correlated color temperature in a range of 1800 K to 6500 K and/or a color rendering index of at least 80 and/or a color point with a standard deviation of color matching (SDCM) of 10 or less compared to the black body locus.

The light-emitting diodes 120 may be colored light-emitting diodes such as RGB light-emitting diodes. The light-emitting diodes 120 may also be white light-emitting diodes such as phosphor-converted blue and/or ultraviolet light-emitting diodes.

Each of the light-emitting diodes 120 may comprise a reflective cup and/or an optical element such as a lens or dome.

The light-emitting diodes 120 are connected with one or more electrically conducting wires, wire bonds and/or electric tracks, which may be at least partly arranged on the carrier.

The light-emitting diodes 120 are of the top-emitting type, so that they are arranged to emit light in a direction away from the second carrier surface 112.

FIG. 1(*b*) shows a cross section of Figure (a) perpendicular to the direction of elongation of the carrier 110.

FIG. 1(*c*) shows a similar cross section as FIG. 1(*b*), but now for light-emitting diodes 120 that are of the side-emitting type. These light-emitting diodes 120 are arranged to emit a first light beam 121*a* with a first light output axis 122*a* and a second light beam 121*b* with a second light output axis 122*b* in opposite directions, substantially parallel to the second carrier surface 112. For the sake of clarity, only the parts of the first and second light output axes 122*a* and 122*b* that fall within the first and second light beams 121*a* and 121*b*, respectively, are shown.

Figure 2:
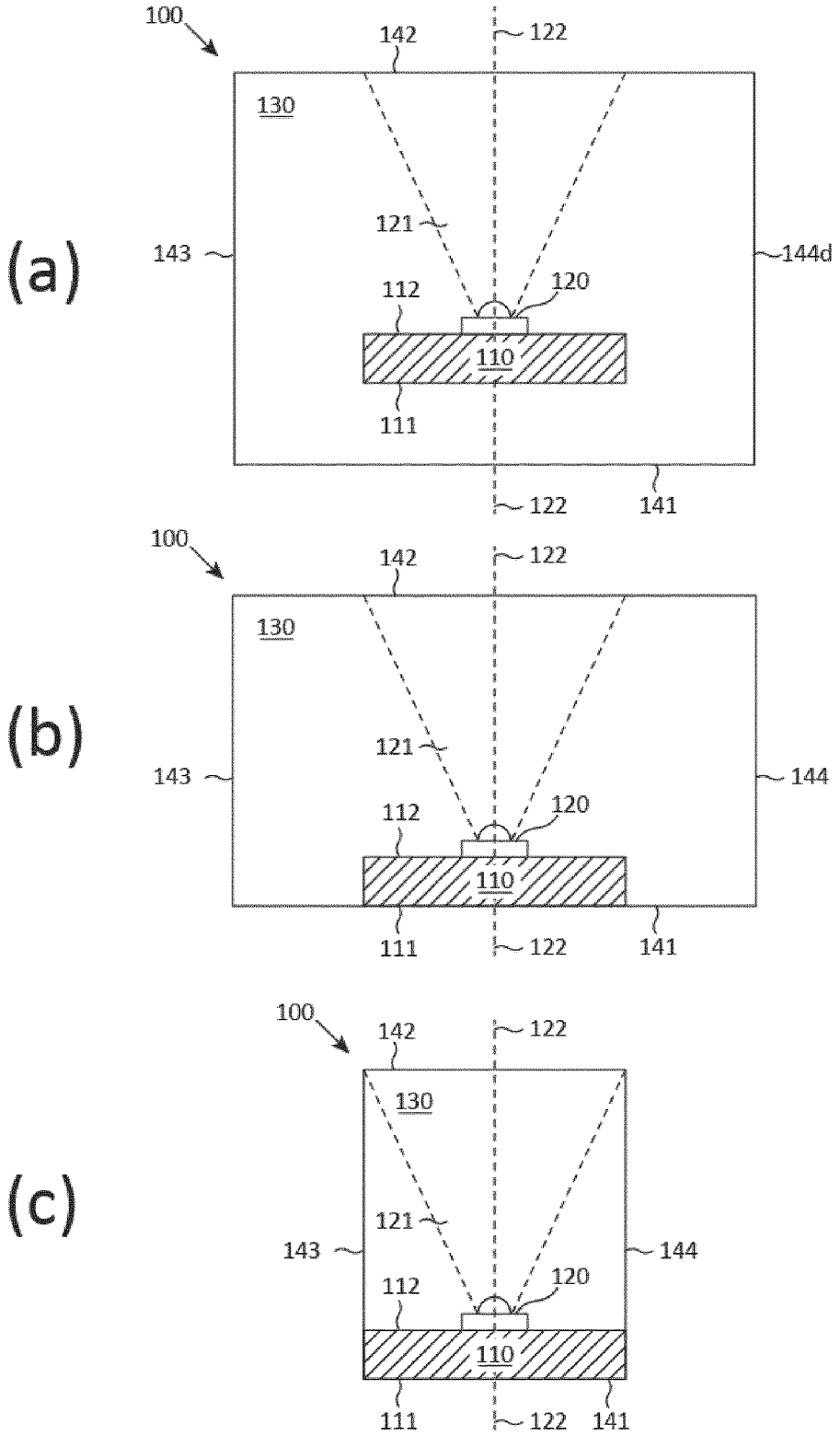
FIGS. 2(*a*) to 2(*c*) show examples of LED strips.

FIG. 2(*a*) shows a cross section of the carrier 110 and the plurality of light-emitting diodes 120 as already shown in FIG. 1(*b*), but now encapsulated in an encapsulant 130. The encapsulant 130 is light-transmissive and it encapsulates the plurality of light-emitting diodes 120 as well as the carrier 110. The carrier 110, the plurality of light-emitting diodes 120, and the encapsulant 130 together constitute a LED strip 100. The LED strip 100 has a first outer surface 141, a second outer surface 142, a third outer surface 144 and a fourth outer surface 144. Each of the first, second, third and fourth outer surfaces 141, 142, 143, and 144, respectively, is different from any of the other outer surfaces.

FIG. 2(*b*) shows a similar cross section as FIG. 2(*a*), but now the first outer surface 141 of the LED strip 100 coincides with the first carrier surface 111. The encapsulant 130 still fully encapsulates the light-emitting diodes 120. The carrier 110 is only partly encapsulated by the encapsulant 130 as it has an exposed first carrier surface 111.

FIG. 2(*c*) shows a similar cross section as FIG. 2(*b*), but now also the side surfaces of the carrier 110 are exposed. The encapsulant 130 still fully encapsulates the light-emitting diodes 120.

In each of FIGS. 2(*a*) to 2(*c*), the first outer surface 141 faces the first carrier surface 111. In FIG. 2(*a*), the first outer surface 141 and the first carrier surface 111 are separated from each other by part of the encapsulant 130. In FIG. 2(*b*), the first outer surface 141 and the first carrier surface 111 partly coincide. In FIG. 2(*c*), the first outer surface 141 and the first carrier surface 111 fully coincide and essentially constitute the same surface.

In each of FIGS. 2(*a*) to 2(*c*), all outer surfaces of the LED strip 100 are planar surfaces. Alternatively, one or more of these outer surfaces may be non-planar instead, such as curved.

In each of FIGS. 2(*a*) to 2(*c*), the LED strip 100 has a rectangular cross section in a direction perpendicular to the elongation direction of the carrier 110. Alternatively, the cross section may have any suitable shape, such as a polygonal shape, both regular as well as irregular.

In each of FIGS. 2(*a*) to 2(*c*), the LED strip 100 may be rigid or flexible.

The LED strip 100 has a length, a width and a height, wherein the length may be larger than 10 times the width and/or larger than 10 times the height. The length of the LED strip 100 may be at least 50 centimeters. The height of the LED strip 100 may be less than 2 centimeters. The width of the LED strip 100 may be less than 2 centimeters.

The LED strip 100 may comprise other electrical components such as one or more drivers and/or one or more controllers for driving and/or controlling the plurality of light-emitting diodes 120, respectively.

Figure 3:
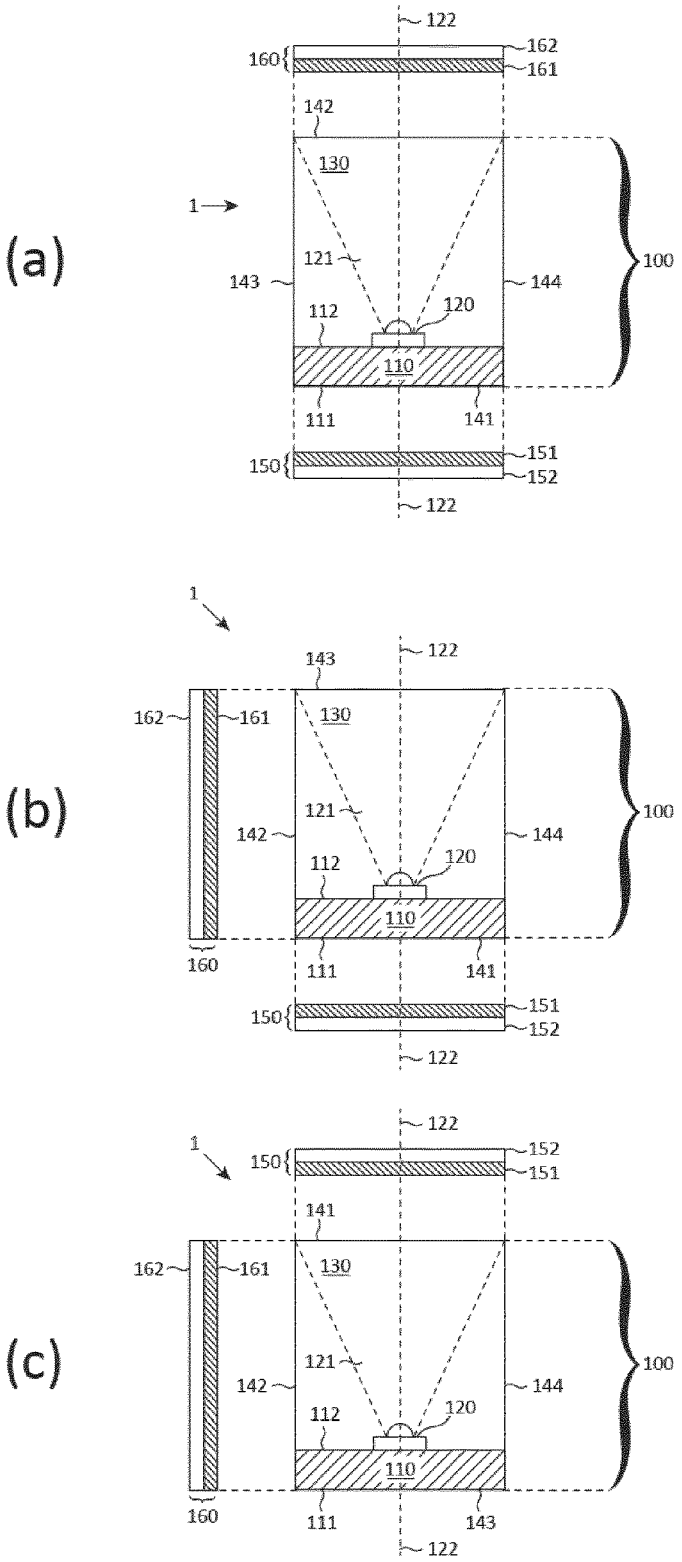
FIGS. 3(*a*) to 3(*c*) show examples of lighting devices.

FIG. 3(*a*) shows a lighting device 1 having the LED strip 100 of FIG. 2(*c*). The first outer surface 141 is provided with a first attachment component 150, and the second outer surface 142 is provided with a second attachment component 160. The first outer surface 141 faces the first carrier surface 111. In fact, the first outer surface 141 and the first carrier surface 111 fully coincide, and essentially constitute the same surface.

For the sake of clarity, FIG. 3(*a*) is a partly exploded view wherein the first and second attachment components 150 and 160 are shown separate from the LED strip 100. However, the first and second attachment components 150 and 160 are actually in contact with the first and second outer surfaces 141 and 142, respectively. The first attachment component 150 is in direct contact (i.e. with no intermediate medium in between) with the carrier 110.

The first attachment component 150 comprises a first adhesive portion 151 covered by a first release liner 152. The second attachment component 160 comprises a second adhesive portion 161 covered by a second release liner 162. Each of the first and second attachment components 150 and 160 may comprise a double-sided tape, or any other type of adhesive that is suitable for sticking two surfaces together, such as glue. Each of the first and second release liners 152 and 162 may be a plastic or polymeric film or layer.

Each light-emitting diode 120 is arranged to provide a light beam 121 with a light output axis 122. The light output axis 122 intersects the first outer surface 141 and also the second outer surface 142. In operation, light beam 121 passes through the light-transmissive encapsulant 130 and is directly incident on the second outer surface 142 whereupon second attachment component 160 is provided.

Two alternative configurations to the configuration of FIG. 3(*a*) are shown in FIGS. 3(*b*) and 3(*c*), respectively. Each of these alternative configurations has the same LED strip 100 as the configuration of FIG. 3(*a*), with first and second attachment components 150 and 160 being provided on first and second outer surfaces 141 and 142, respectively.

In the alternative configuration of FIG. 3(*b*), the first outer surface 141 is the same as in FIG. 3(*a*), but the second outer surface 142 is at a different location. Similar to FIG. 3(*a*), the first outer surface 141 and the first carrier surface 111 fully coincide and essentially constitute the same surface. The light output axis 122 intersects the first outer surface 141 but not the second outer surface 142. In operation, light beam 121 passes through the light-transmissive encapsulant 130 and is directly incident on the third outer surface 143 whereupon no attachment component is provided.

In the alternative configuration of FIG. 3(*c*), the second outer surface 142 is the same as in FIG. 3(*b*), but now the first outer surface 141 is at a different location. Contrary to FIGS. 3(*a*) and 3(*b*), the first outer surface 141 faces away from the first carrier surface 111. The light output axis 122 intersects the first outer surface 141 but not the second outer surface 142. In operation, light beam 121 passes through the light-transmissive encapsulant 130 and is directly incident on the first outer surface 141 whereupon the first attachment component 150 is provided.

In each of FIGS. 3(*a*) to 3(*c*), the first outer surface 141 and the second outer surface 142 are planar surfaces. In FIG. 3(*a*), the first outer surface 141 and the second outer surface 142 are parallel planar surfaces. In FIGS. 3(*b*) and 3(*c*), the first outer surface 141 and the second outer surface 142 are perpendicular planar surfaces. Alternatively, the first outer surface 141 and the second outer surface 142 may be any other combination of surfaces, planar or non-planar, parallel or non-parallel, as long as the light output axis 122 intersects at least one of the first outer surface 141 and the second outer surface 142.

In each of FIGS. 3(*a*) to 3(*b*), the second attachment component 160 may be translucent, such as transparent. Depending on whether or not the carrier 110 is light-transmissive, the first attachment component 150 may also be translucent, such as transparent.

In each of FIGS. 3(*a*) to 3(*b*), each of the first adhesive portion 151, the first release liner 152, the second adhesive portion 161 and the second release liner 162 may be arranged along the full length of the LED strip 100, or only along one or more portions thereof.

Figure 4:
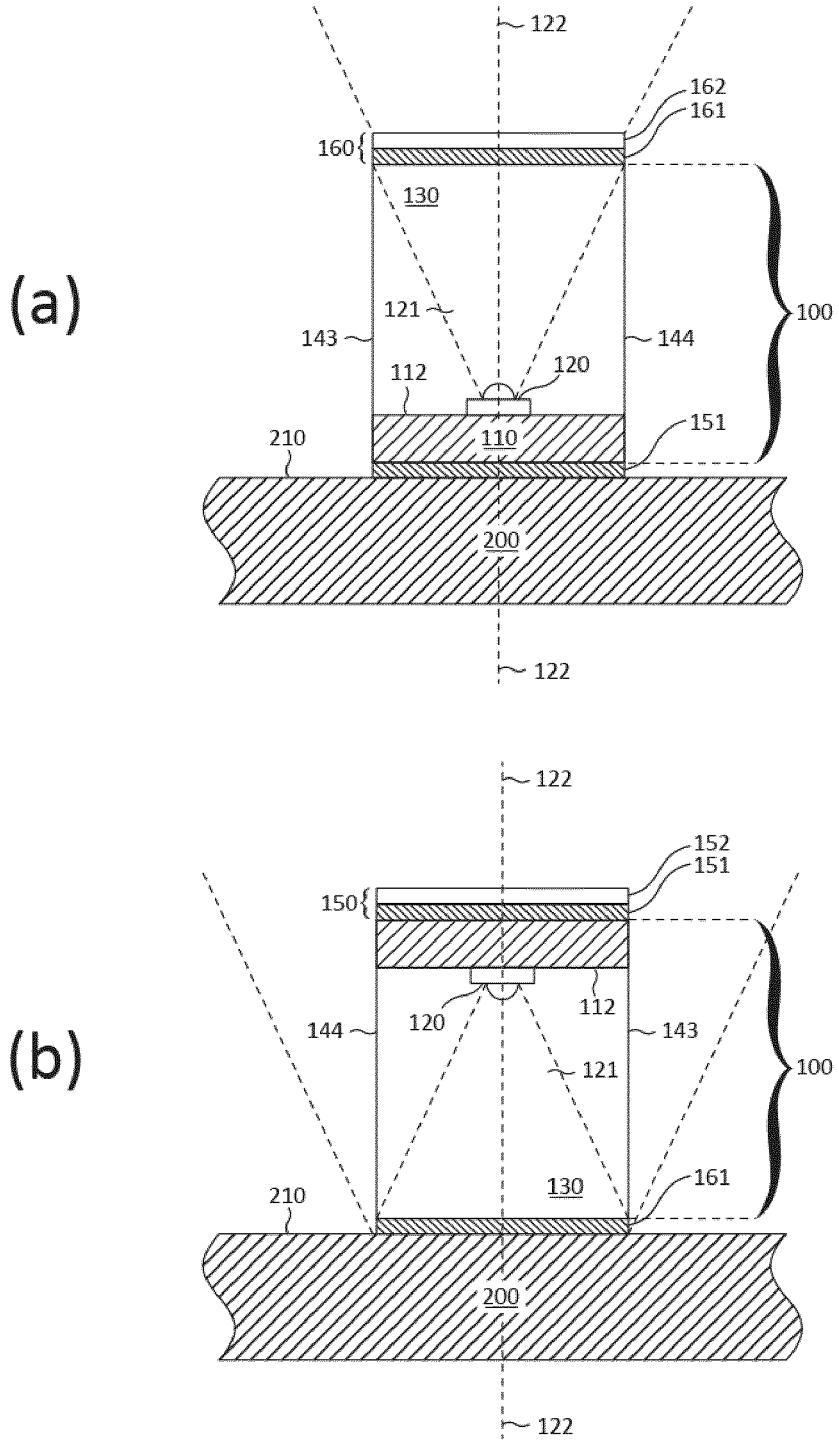
FIGS. 4(*a*) and 4(*b*) show a lighting device mounted to an object in first and second mounting orientations.

FIG. 4(*a*) shows the lighting device of FIG. 3(*a*) after it has been mounted to a mounting surface 210 of an object 200 in a first mounting orientation. The first release liner 152 has been removed from the first attachment component 150, and the lighting device is mounted to the mounting surface 210 by means of the first adhesive portion 151. The second attachment component 160 is still intact.

In the first mounting orientation of FIG. 4(*a*), the carrier 110 is in contact with the object 200 via the first adhesive portion 151. When the carrier 110 and the object 200 are thermally conductive, for example when the object 200 is made of metal, thermal energy can easily be dissipated from the lighting device in this orientation.

FIG. 4(*b*) shows the lighting device of FIG. 3(*a*) after it has been mounted to the mounting surface 210 in a second mounting orientation. Now, the second release liner 162 has been removed from the second attachment component 160, and the lighting device is mounted to the mounting surface 210 by means of the second adhesive portion 161. The first attachment component 150 is still intact.

In the first mounting orientation shown in FIG. 4(*a*), the light-emitting diodes 120 are arranged to emit light beams 121 in a direction away from the mounting surface 120 towards the second attachment component 160. Each of the second adhesive portion 161 and the second release liner 162 is light-transmissive, allowing the light beams 121 to exit from the lighting device. The second attachment component 160 is light-transmissive, and may be translucent, such as transparent.

In the second mounting orientation shown in FIG. 4(*b*), the light-emitting diodes 120 are arranged to emit light beams 121 in a direction towards the mounting surface 120. Because the second adhesive portion 161 is light-transmissive, the light beams 121 are incident on the mounting surface 120.

In FIGS. 4(*a*) and 4(*b*), the object 200 is light-reflective. Consequently, in the second mounting orientation shown in FIG. 4(*b*), the light beams 121 that exit from the lighting device are subsequently reflected by the object 200. The light distribution obtained in the first mounting orientation shown in FIG. 4(*a*) is different from the light distribution obtained in the second mounting orientation shown in FIG. 4(*b*). The former light distribution provides direct lighting, while the latter provides indirect lighting via reflection from the object 200.

Figure 5:
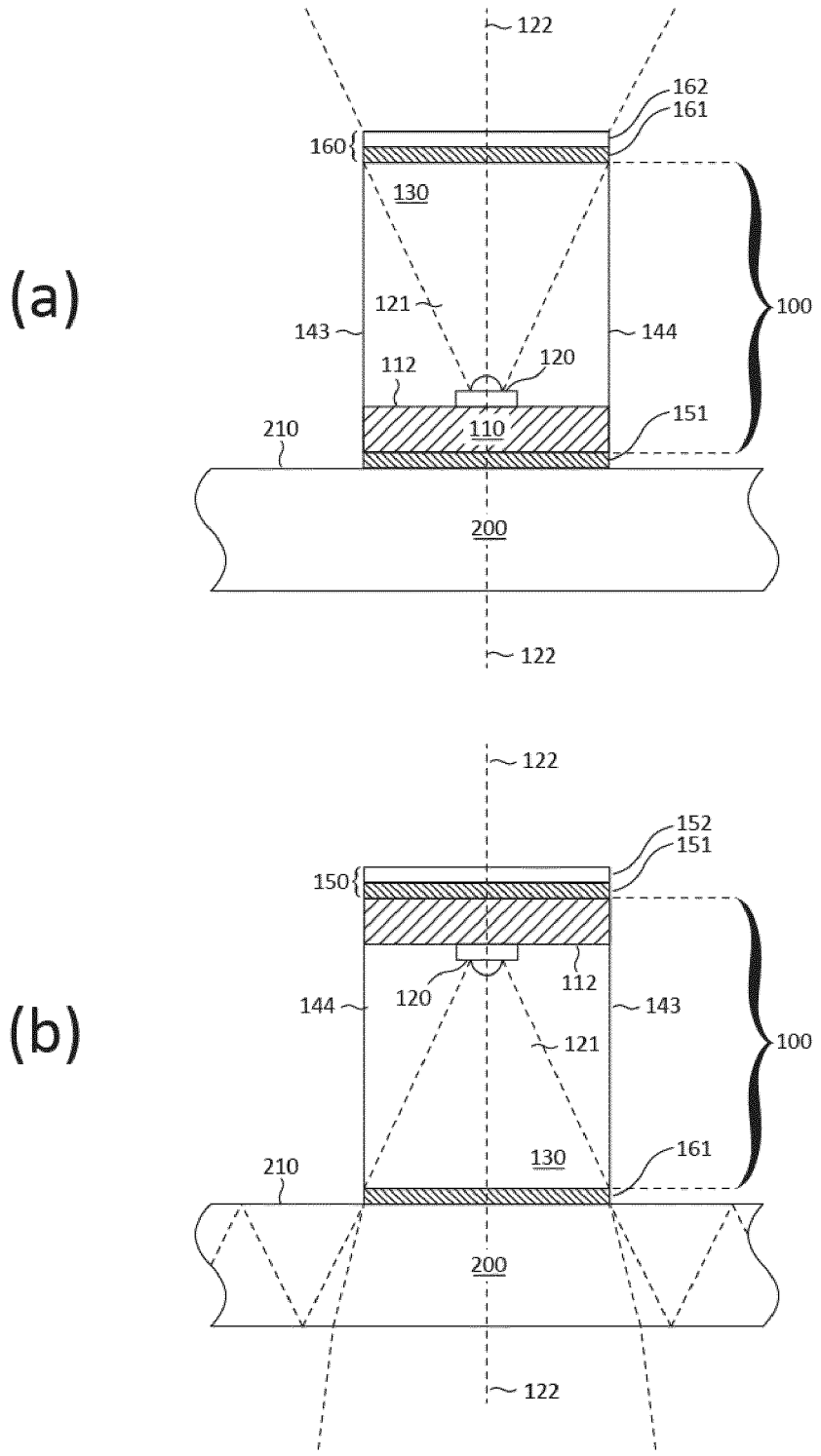
FIGS. 5(*a*) and 5(*b*) show a lighting device mounted to an object in first and second mounting orientations.

FIGS. 5(*a*) and 5(*b*) again show the lighting device of FIG. 3(*a*) after it has been mounted to a mounting surface 210 of an object 200 in a first mounting orientation and a second mounting orientation, respectively, but now the object 200 is light-transmissive instead of light-reflective. The object 200 may be translucent, such as transparent.

The light distribution obtained in the first mounting orientation shown in FIG. 5(*a*) is similar to that of FIG. 4(*a*). In the second mounting orientation of FIG. 5(*b*), the light beams 121 that exit the lighting device via the second adhesive portion 161 enter the object 200. At least part of the light beams 121 will pass through the object 200, while other parts may be guided by the object 200 by means of total internal reflection. Again, the light distribution obtained in the first mounting orientation shown in FIG. 5(*a*) is different from the light distribution obtained in the second mounting orientation shown in FIG. 5(*b*).

Figure 6:
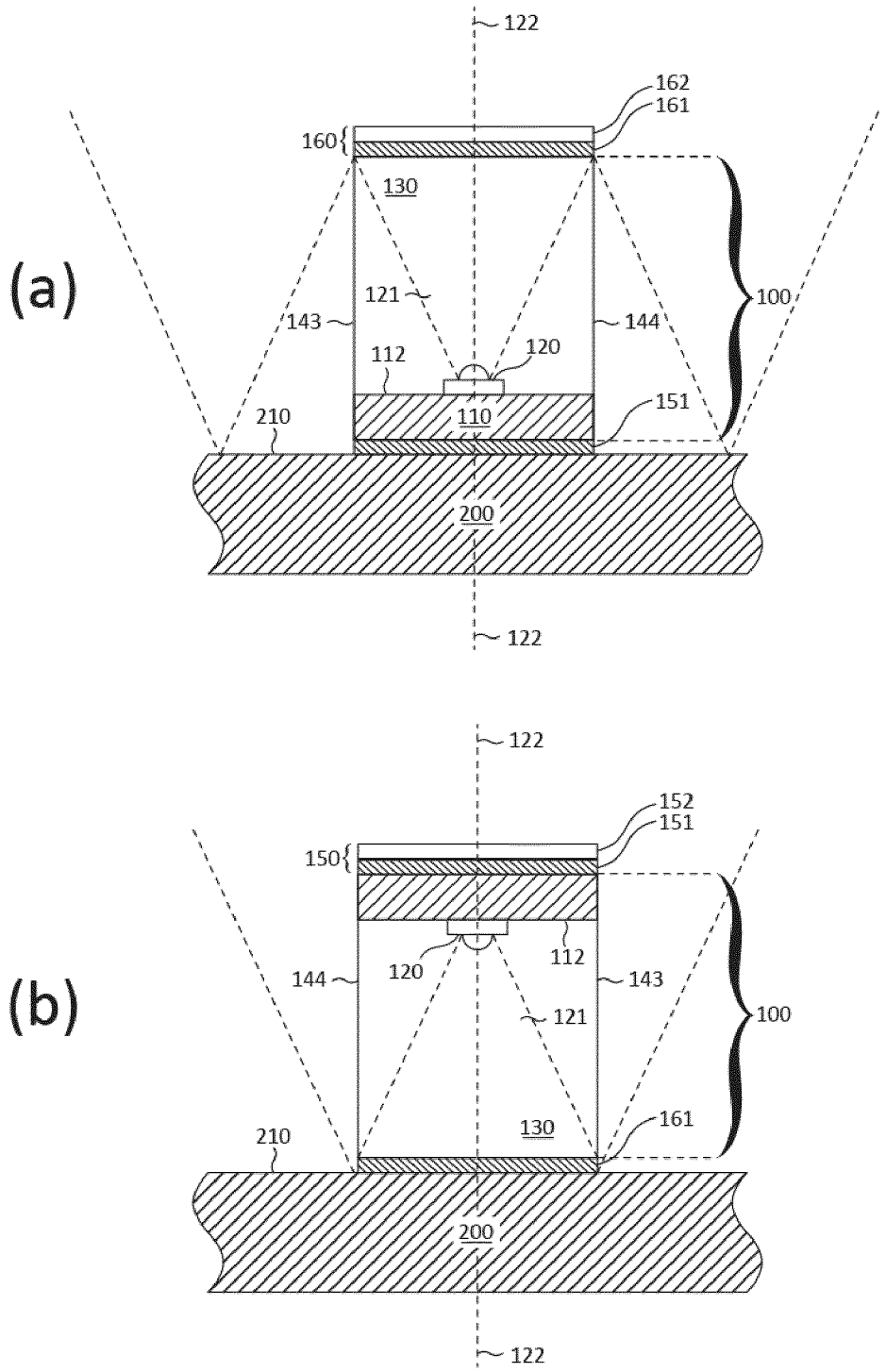
FIGS. 6(*a*) and 6(*b*) show a lighting device mounted to an object in first and second mounting orientations.

In FIGS. 6(*a*) and 6(*b*), the second release liner 162 is light-reflective. Consequently, in the first mounting orientation of FIG. 6(*a*), the light beams 121 are reflected back towards the object 200, which again is light-reflective, similar to FIGS. 4(*a*) and 4(*b*). The light distribution obtained in the first mounting orientation of FIG. 6(*a*) is different from the light distribution obtained in the second mounting orientation of FIG. 6(*b*), at least because it is wider.

Figure 7:
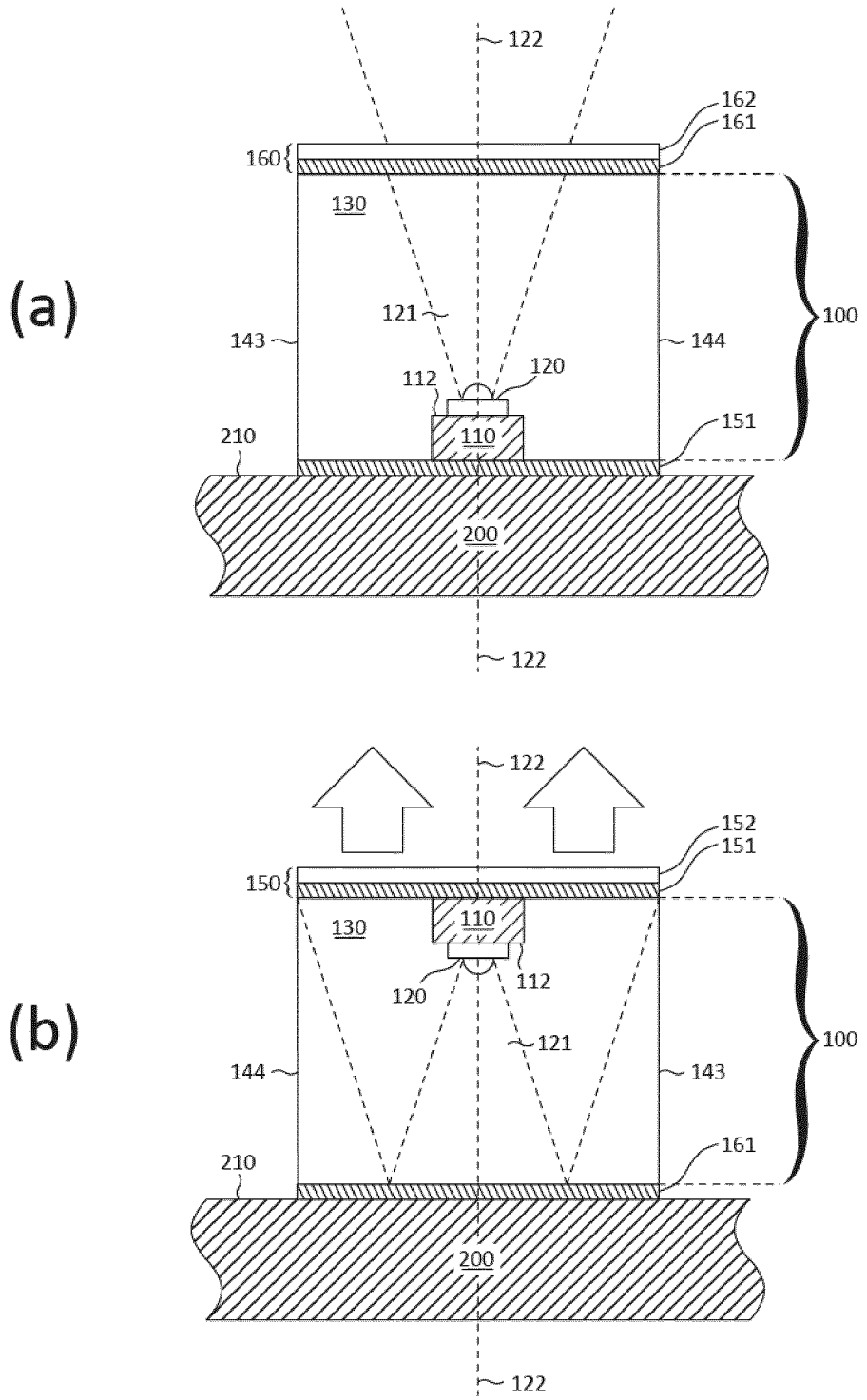
FIGS. 7(*a*) and 7(*b*) show a lighting device mounted to an object in first and second mounting orientations.

In FIGS. 7(*a*) and 7(*b*), the LED strip 100 is of the type as illustrated in FIG. 2(*b*). In FIG. 7(*a*), the lighting device is mounted to the mounting surface 210 of a light-reflective object 200 in a first mounting orientation, using the first adhesive portion 151 of the first attachment component 150. In FIG. 7(*b*), the lighting device is mounted to the mounting surface 210 of the light-reflective object 200 in a second mounting orientation, using the second adhesive portion 161 of the second attachment component 160.

In FIGS. 7(*a*) and 7(*b*), the first attachment component 150 comprises a phosphor for converting the light that is emitted by the light-emitting diodes 120 by means of photoluminescence, while the second attachment component 160 is light-transmissive. In other words, the first attachment component 150 is arranged to provide a first optical effect and the second attachment component 160 is arranged to provide a second optical effect different from the first optical effect, the first optical effect being conversion.

In the first mounting orientation of FIG. 7(*a*), the light beams 121 emitted by the light-emitting diodes 120 are transmitted by the light-transmissive second attachment component 160. In the second mounting orientation of FIG. 7(*b*), the light beams 121 emitted by the light-emitting diodes 120 are incident on the first attachment component 150, and subsequently converted by the phosphor that is comprised in at least one of the first adhesive portion 151 and the first release liner 152. As a result, a relatively strong difference (or contrast) between the light distributions in the first and second mounting orientations is obtained.

Alternatively, the first and second optical effects may also be different in terms of refraction, diffraction, reflection and diffusion, again to obtain a relatively strong difference in light distribution between the first and second mounting orientations. The optical effect provided by an attachment component may extend uniformly along the length of the LED strip, but it may also vary from one location to the other.

In FIGS. 7(*a*) and 7(*b*), the carrier 110 does not extend across the full width of the encapsulant 130, thereby exposing part of the first attachment component 150, allowing the light beams 121 to be incident on the first attachment component 150 after being reflected. Alternatively, the carrier 110 may extend across the full width of the encapsulant 130, provided that it is light-transmissive, for example translucent, such as transparent.

Figure 8:
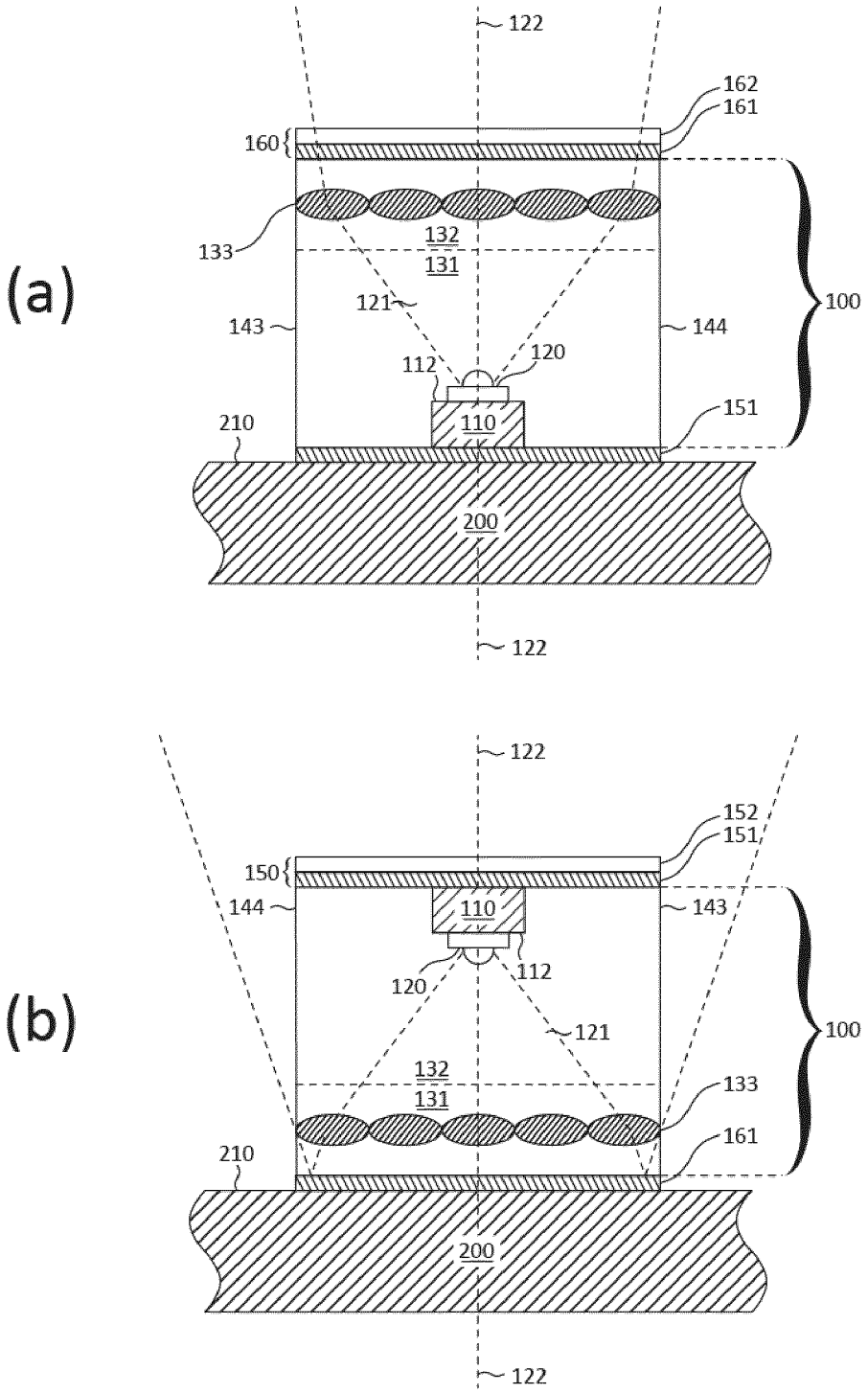
FIGS. 8(*a*) and 8(*b*) show a lighting device mounted to an object in first and second mounting orientations.

In FIGS. 8(*a*) and 8(*b*), the lighting device has a LED strip 100 wherein the encapsulant comprises a first encapsulant region 131 and a second encapsulant region 132 different from the first encapsulant region. The first encapsulant region 131 is adjacent to the carrier 110 and the second encapsulant region 132 is adjacent to the second attachment component 160. The second encapsulant region 132 comprises an array of lenses 133 for shaping the light beams 121 emitted by the light-emitting diodes 120. When the light beam 121 is incident on the array of lenses 133, the spread of the light beam is reduced. In other words, the array of lenses 133 acts as a light collimator. When the lighting device is mounted on a light-reflective object 200, depending on whether it is mounted in a first mounting orientation (see FIG. 8(*a*)) or in a second mounting orientation (see FIG. 8(*b*)), the light distribution provided by the lighting device will have a different beam spread.

In FIGS. 8(*a*) and 8(*b*), the second encapsulant region 132 comprises a plurality of lenses 133 arranged in an array. Alternatively, any number of lenses may be used, and they may be arranged in any configuration. The distribution of lenses may be uniform along the length of the LED strip, but it may also vary from one location to the other. Instead of lenses, the second encapsulant region 132 may comprise any other plurality of light-redirecting structures, for example light-refracting structures such as prisms or light-scattering structures such as embedded particles. Examples of suitable light scattering particles are particles made from barium sulfate ($BaSO_4$), aluminum oxide ($Al_2O_3$) and titanium dioxide ($TiO_2$).

In FIGS. 8(*a*) and 8(*b*), the first encapsulant region 131 is free of any light-redirecting structures. Alternatively, the first encapsulant region 131 may also comprise light-redirecting structures, either of the same type as those comprised in the second encapsulant region 132, or of a different type. The light-redirecting structures may also be present in the encapsulant 130 with a gradient in a direction parallel to the light output axis 122. Preferably, the first and second encapsulant regions 131 and 132, respectively, are configured such that they have different beam shaping properties.

Figure 9:
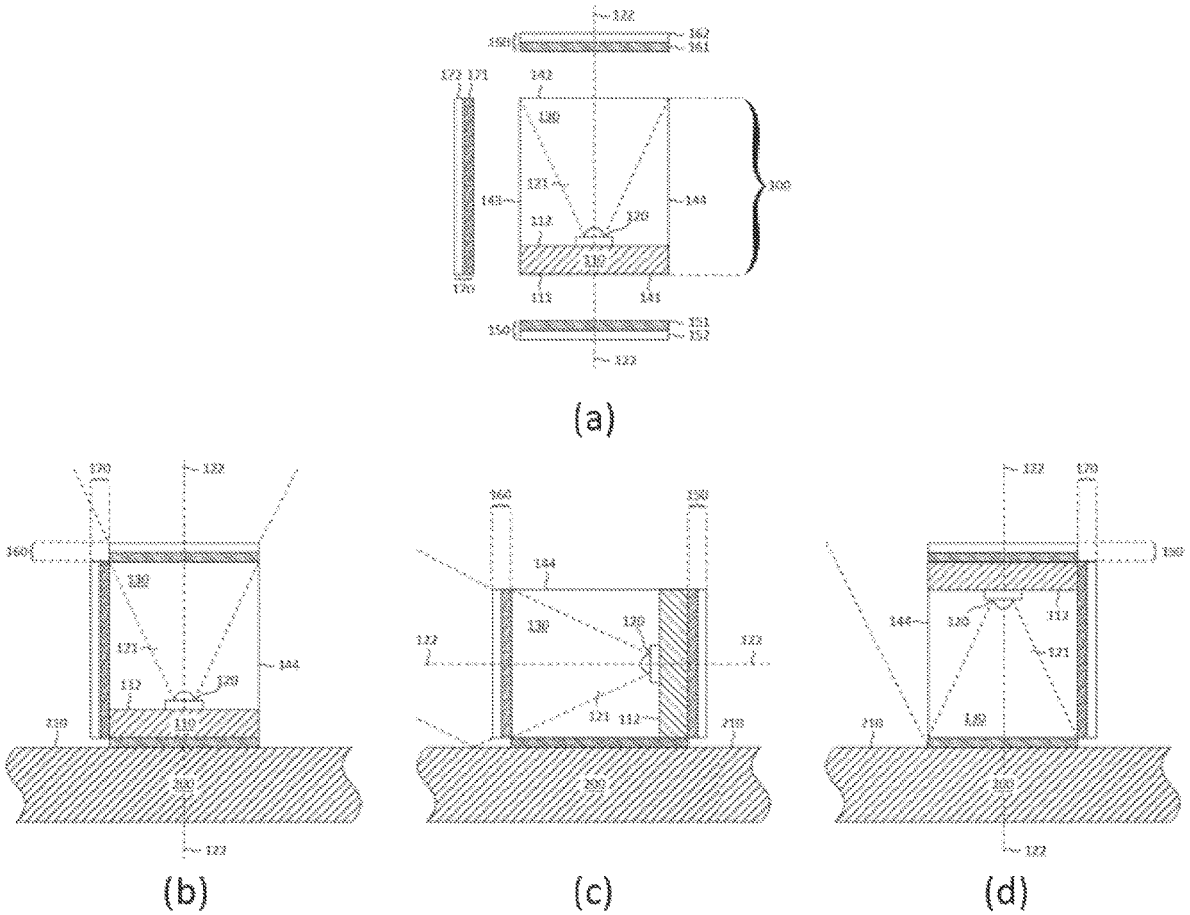
FIGS. 9(*a*) to 9(*d*) show a lighting device mounted to an object in first, second and third mounting orientations.

FIG. 9(*a*) shows an exploded view of a lighting device having an LED strip 100 with a first outer surface 141, a second outer surface 142, a third outer surface 143, and a fourth outer surface 144. The lighting device also has a first attachment component 150 arranged on the first outer surface 141, a second attachment component 160 arranged on the second outer surface 142, and a third attachment component 170 arranged on the third outer surface 143. The first attachment component 150 is for attaching the lighting device to a mounting surface 210 in a first mounting orientation, the second attachment component 160 is for attaching the lighting device to a mounting surface 210 in a second mounting orientation, and the third attachment component 170 is for attaching the lighting device to a mounting surface 210 in a third mounting orientation. The first attachment component 170 comprises a first adhesive portion 151 covered by a first release liner 152, the second attachment component 160 comprises a second adhesive portion 161 covered by a second release liner 162, and the third attachment component 170 comprises a third adhesive portion 171 covered by a third release liner 172.

Each light-emitting diode 120 is arranged to provide a light beam 121 with a light output axis 122. The light output axis 122 intersects the first outer surface 141 and the second outer surface 142, but not the third outer surface 143 and the fourth outer surface 144.

The first and second attachment components 150 and 160, respectively, are arranged on parallel planes, while the third attachment component 170 is arranged on a plane that is oriented perpendicular to these parallel planes.

FIGS. 9(*b*) to 9(*d*) show the lighting device of FIG. 9(*a*) after it has been mounted to a mounting surface 210 of an object 200 in a first mounting orientation (FIG. 9(*b*)), a second mounting orientation (FIG. 9(*c*)) and a third mounting orientation (FIG. 9(*d*)), respectively. In each of these mounting orientations a different light distribution is obtained.

In each of FIGS. 4 to 9, the lighting device and the object on which it is mounted may together be part of a luminaire.

An object of the invention is to provide a lighting device that can be attached to a mounting surface of an object, wherein the lighting device comprises an LED strip, and wherein the lighting device can be used in a variety of different applications that may each require a different light distribution from the lighting device. From the above description of various embodiments it is clear that the objective is achieved by means of any lighting device comprising an LED strip with an elongated carrier having a first carrier surface and an opposite second carrier surface, a plurality of light-emitting diodes arranged on the second carrier surface, and a light-transmissive encapsulant encapsulating the plurality of light-emitting diodes, as long as the lighting device further comprises a first attachment component arranged on a first outer surface of the LED strip and a second attachment component arranged on a second outer surface of the LED strip, wherein each light-emitting diode is arranged to provide a light beam with a light output axis that intersects at least one of the first and second outer surfaces.

For each such lighting device, a first light output is provided in the first mounting orientation and a second light output is provided in the second mounting orientation, the first light output being different from the second light output. In use, the lighting device is mounted on a mounting surface of an object. The extent of the difference in light output will depend on whether the object is light-reflective or light-transmissive, but irrespective of the type of object on which the lighting device is mounted, the first mounting orientation will always give a different light output than the second mounting orientation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements.

The mere fact that certain features are recited in mutually different dependent claims does not indicate that a combination of these features cannot be used to advantage. The various aspects discussed above can be combined in order to provide additional advantages. Further, the person skilled in the art will understand that two or more embodiments may be combined.

The invention claimed is:

1. A lighting device arranged to be attached to a mounting surface of an object, the lighting device comprising an LED strip (100), the LED strip comprising:

an elongated carrier having a first carrier surface and an opposite second carrier surface, a plurality of light-emitting diodes arranged on the second carrier surface, and a light-transmissive encapsulant encapsulating the plurality of light-emitting diodes, wherein the lighting device further comprises:

a first attachment component arranged on a first outer surface of the LED strip for attaching the lighting device to the mounting surface in a first mounting orientation, the first attachment component comprising a first adhesive portion covered by a first release liner, and a second attachment component arranged on a second outer surface of the LED strip for attaching the lighting device to the mounting surface in a second mounting orientation, the second attachment component comprising a second adhesive portion covered by a second release liner, and wherein each light-emitting diode is arranged to provide a light beam with a light output axis, the light output axis intersecting at least one of the first and second outer surfaces, characterized in that the first attachment component is arranged to provide a first optical effect and the second attachment component is arranged to provide a second optical effect different from the first optical effect, at least one of the first and second optical effects being an effect chosen from the group consisting of refraction, diffraction, reflection, diffusion and conversion.

2. The lighting device according to claim 1, wherein the first outer surface coincides with the first carrier surface.

3. The lighting device according to claim 1, wherein the first and second outer surfaces are parallel planar surfaces.

4. The lighting device according to claim 1, wherein the first and second outer surfaces are non-parallel planar surfaces.

5. The lighting device according to claim 4, wherein the first and second outer surfaces are perpendicular planar surfaces.

6. The lighting device according to claim 1, wherein the elongated carrier is light-reflective.

7. The lighting device according to claim 1, wherein the elongated carrier is light-transmissive.

8. The lighting device according to claim 7, wherein the elongated carrier is arranged to redirect light.

9. The lighting device according to claim 1, wherein the first outer surface faces the first carrier surface, and wherein the second attachment component is translucent.

10. The lighting device according to claim 1, wherein at least one of the first and second optical effects is provided by the respective first or second adhesive portion.

11. The lighting device according to claim 1, wherein at least one of the first and second optical effects is provided by the respective first or second release liner.

12. The lighting device according to claim 1, wherein the encapsulant comprises a first encapsulant region and a second encapsulant region different from the first encapsulant region, the first encapsulant region being adjacent to the carrier and the second encapsulant region being adjacent to the second attachment component, wherein the second encapsulant region comprises one or more light-redirecting structures for shaping the light beams.

13. The lighting device according to claim 1, wherein the LED strip comprises a third outer surface and wherein the lighting device comprises a third attachment component arranged on the third outer surface for attaching the lighting device to the mounting surface in a third mounting orientation, the third attachment component comprising a third adhesive portion covered by a third release liner.

14. A luminaire comprising the lighting device according to claim 1, wherein the luminaire further comprises the object, and wherein the lighting device is attached to the mounting surface.

* * * * *